US009897409B2

(12) United States Patent
Liao

(10) Patent No.: US 9,897,409 B2
(45) Date of Patent: Feb. 20, 2018

(54) FLOW DIVIDING VALVE STRUCTURE FOR TOY GUN

(71) Applicant: GUAY GUAY TRADING CO., LTD., Changhua County (TW)

(72) Inventor: Yin-Hsi Liao, Changhua County (TW)

(73) Assignee: GUAY GUAY TRADING CO., LTD., Changhua County (TW)

( * ) Notice: Subject to any disclaimer, the term of this patent is extended or adjusted under 35 U.S.C. 154(b) by 0 days.

(21) Appl. No.: 15/399,751

(22) Filed: Jan. 6, 2017

(65) Prior Publication Data

US 2017/0328671 A1 Nov. 16, 2017

(30) Foreign Application Priority Data

May 13, 2016 (TW) ..... 105207005 U

(51) Int. Cl.
*F41B 11/723* (2013.01)
*F41B 11/89* (2013.01)

(52) U.S. Cl.
CPC ..... *F41B 11/723* (2013.01); *F41B 11/89* (2013.01)

(58) Field of Classification Search
CPC ..... F41B 11/72; F41B 11/721; F41B 11/722; F41B 11/723; F41B 11/724; F41B 11/80; F41B 11/89
USPC .... 124/71, 72, 73, 74, 75, 76, 77; 42/54, 55
See application file for complete search history.

(56) References Cited

U.S. PATENT DOCUMENTS 1,266,764 A * 5/1918 Blair ..... A63B 69/409 124/81
5,660,160 A * 8/1997 Prescott, Jr. ..... F41B 11/68 124/70
6,553,983 B1 * 4/2003 Li ..... F41B 11/721 124/73
6,832,604 B1 * 12/2004 Thompson ..... F41B 11/57 124/48
2006/0207585 A1 * 9/2006 Liang ..... F41B 11/55 124/74

* cited by examiner

*Primary Examiner* — Bret Hayes
(74) *Attorney, Agent, or Firm* — Leong C. Lei

(57) ABSTRACT

A flow dividing valve structure for a toy gun includes: a propulsion portion; a rotating auxiliary portion extended from one face of the propulsion portion; and a latching portion, configured on one end of the rotating auxiliary portion far away from the propulsion portion, where the rotating auxiliary portion is configured with a plurality of wing portions each twisted toward a direction away from the propulsion portion so as to be allowed to have at least one twisted face. Whereby, high pressure gas will drive the rotating auxiliary portion to rotate through the wing portions when flowing through the rotating auxiliary portion, and further remove the frost generated inside a gas chamber so as to prevent the unsmooth operation of the flow dividing valve.

4 Claims, 7 Drawing Sheets

FLOW DIVIDING VALVE STRUCTURE FOR TOY GUN

TECHNICAL FIELD OF THE INVENTION

The present invention relates to a toy gun, and more particularly to a flow dividing valve structure for a toy gun capable of removing the frost in a gas chamber thereof.

DESCRIPTION OF THE PRIOR ART

Currently, toy guns are popular among adults and children; they fully satisfy the desire of players incapable of taking real guns with making a shootout game such as survival game such that they can be said to be safe and may meet the needs of players. However, the structures of toy guns have been improved continuously to allow the feel or firing moment of toy guns to be closer to real gun texture. Among them, taking the flow dividing valve (dart) structure of a gas gun as an example, the general flow dividing valve is very simple, mainly including a long rod, one end of which is provided with an engagement seat allowing to fix an elastic element, and another end of which is provided with a flat plane allowing the impact of gas acted thereon in such a way that an air cylinder can be pushed rearward smoothly through the flow dividing valve to make a bolt reset action.

However, when conventional flow dividing valves are in a use state, there are the following problems and defects to be overcome: although the conventional flow dividing valve can push an air cylinder to make a bolt reset action, fuel gas will absorb heat upon gasification, which causes frost to be generated in a gas chamber. As a result, the flow dividing valve is not mover smoothly and will be hindered once the gas chamber is frosted over.

SUMMARY OF THE INVENTION

To overcome the defects mentioned above, the present invention is proposed.

The main object of the present invention is to provide a flow dividing valve for a toy gun, allowing a flow dividing valve to be rotated through wing portions configured on a rotating auxiliary portion, thereby removing the frost generated inside a gas chamber effectively.

Another object of the present invention is to provide a flow dividing valve for a toy gun, capable of gathering up gas through the design of a concave groove portion, allowing the gas chamber to be sealed more smoothly, and further moving a piston more smoothly to reset it completely.

To achieve the objects mentioned above, the present invention proposes a flow dividing valve structure for a toy gun, including: a propulsion portion, at least one concave groove portion configured on one face thereof; a rotating auxiliary portion extended from one face of the propulsion portion, a flow dividing hole allowing gas to be passed through being configured thereon, the rotating auxiliary portion being configured with a plurality of wing portions each being twisted in a direction away from the propulsion portion, allowing the plurality of wing portions to respectively have at least one twisted face, and a flow dividing hole allowing gas to be passed through being configured on a center of each wing portion; and a latching portion, configured on one end of the rotating auxiliary portion far away from the propulsion portion, and allowing an elastic element to be engaged therewith. Whereby, high pressure gas will be in contact with the twisted faces when guided in through the flow dividing hole to drive the whole flow dividing valve to rotate, thereby removing the frost from the gas chamber, and part of the gas will be bounced back to the concave groove portion after striking a piston, allowing the flow dividing valve to be pushed in a direction away from the piston by gas pressure. In addition, a bolt can be reset completely after gas chamber is airtight, and the piston can be pushed to move even if the gas is insufficient. Furthermore, eddy current will be yielded because of the rotation of the flow dividing valve, allowing the pressurized gas to push a bullet forward so as to stabilize a bullet speed.

DETAILED DESCRIPTION OF THE PREFERRED EMBODIMENTS

Figure 1:
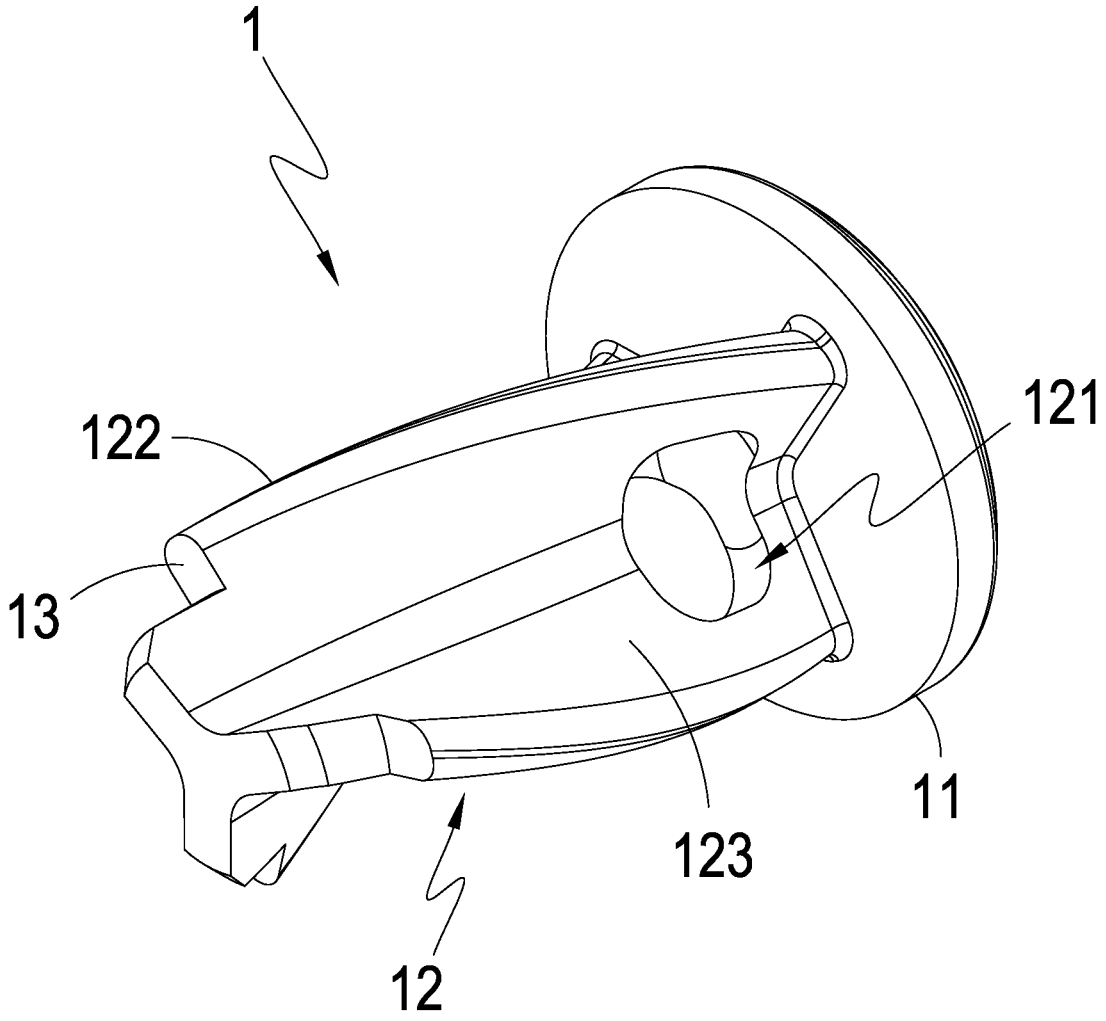
FIGS. 1 and 2 respectively are a flow dividing valve of a preferred embodiment according to the present invention.
Figure 2:
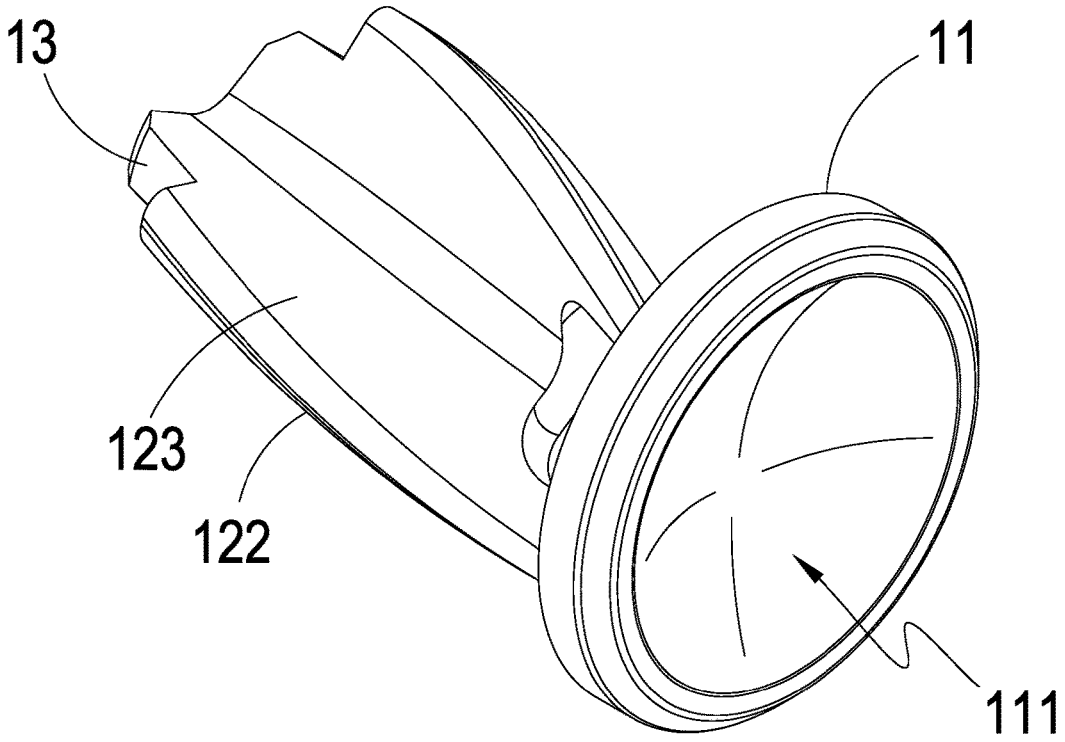
Figure 3:
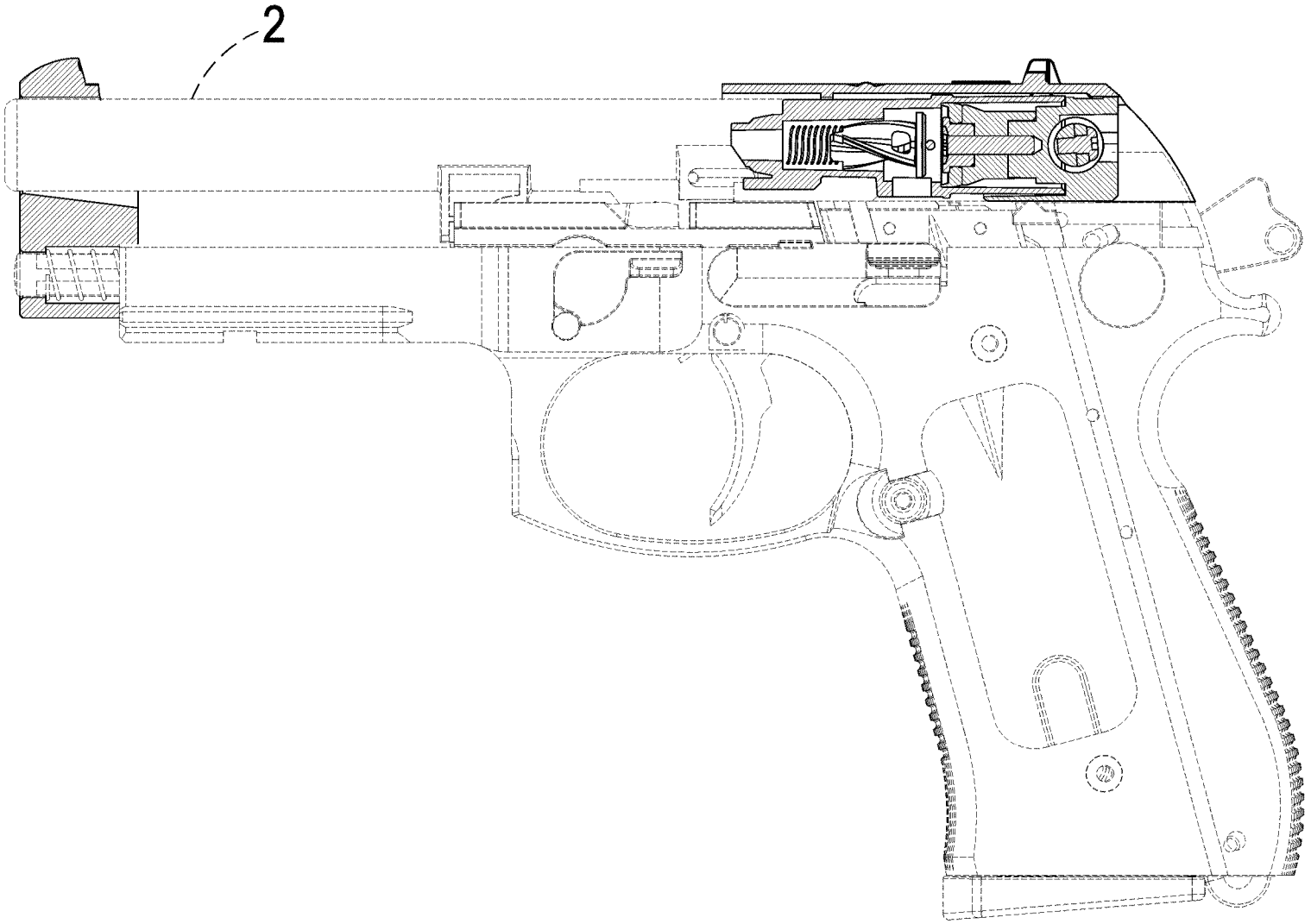
FIG. 3 is a schematic view of the embodiment of the present invention in combination with a gas chamber.
Figure 4:
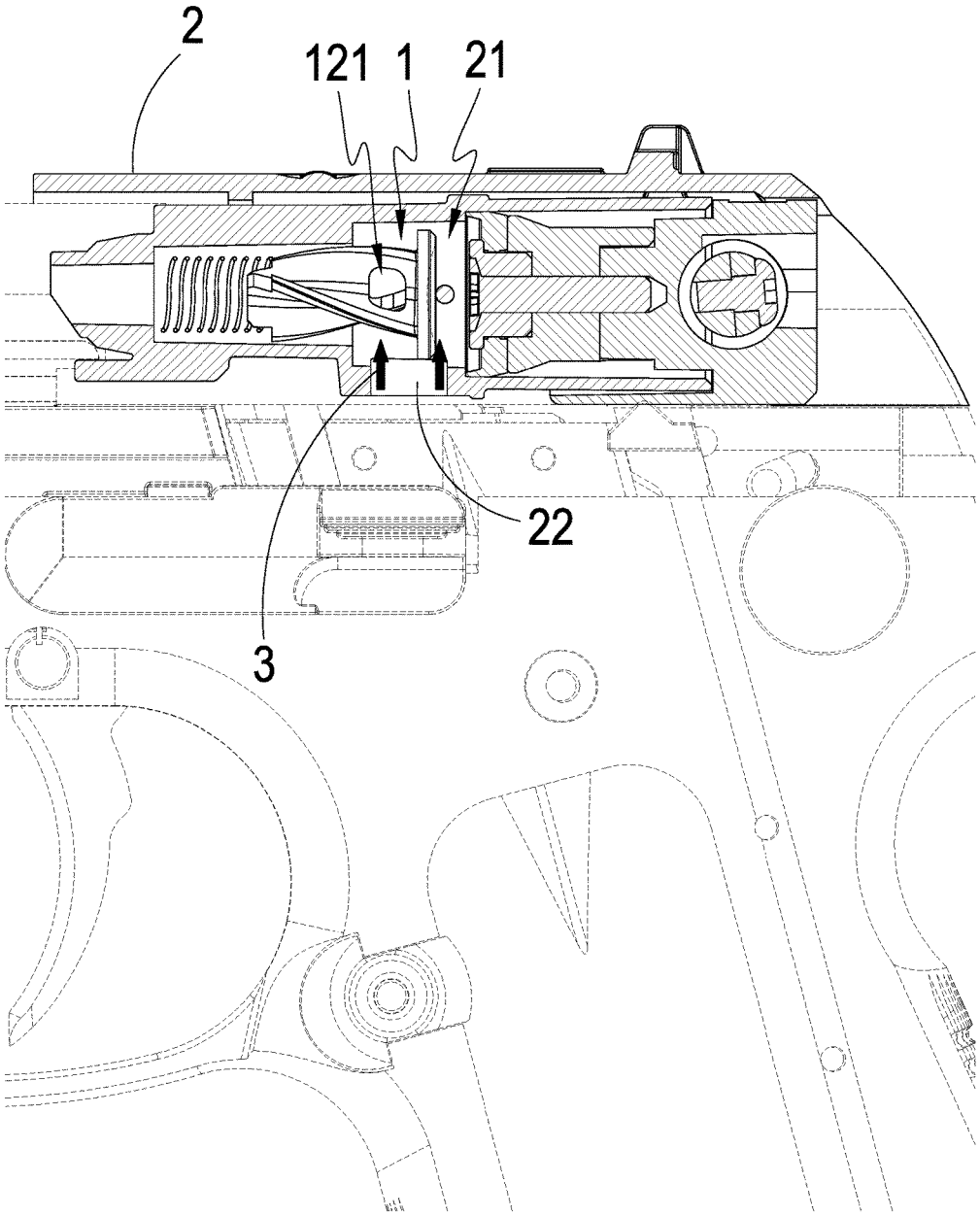
FIG. 4 is a schematic view of the present invention, illustrating the action of gas flow flowing through a flow dividing hole and the air chamber.
Figure 5:
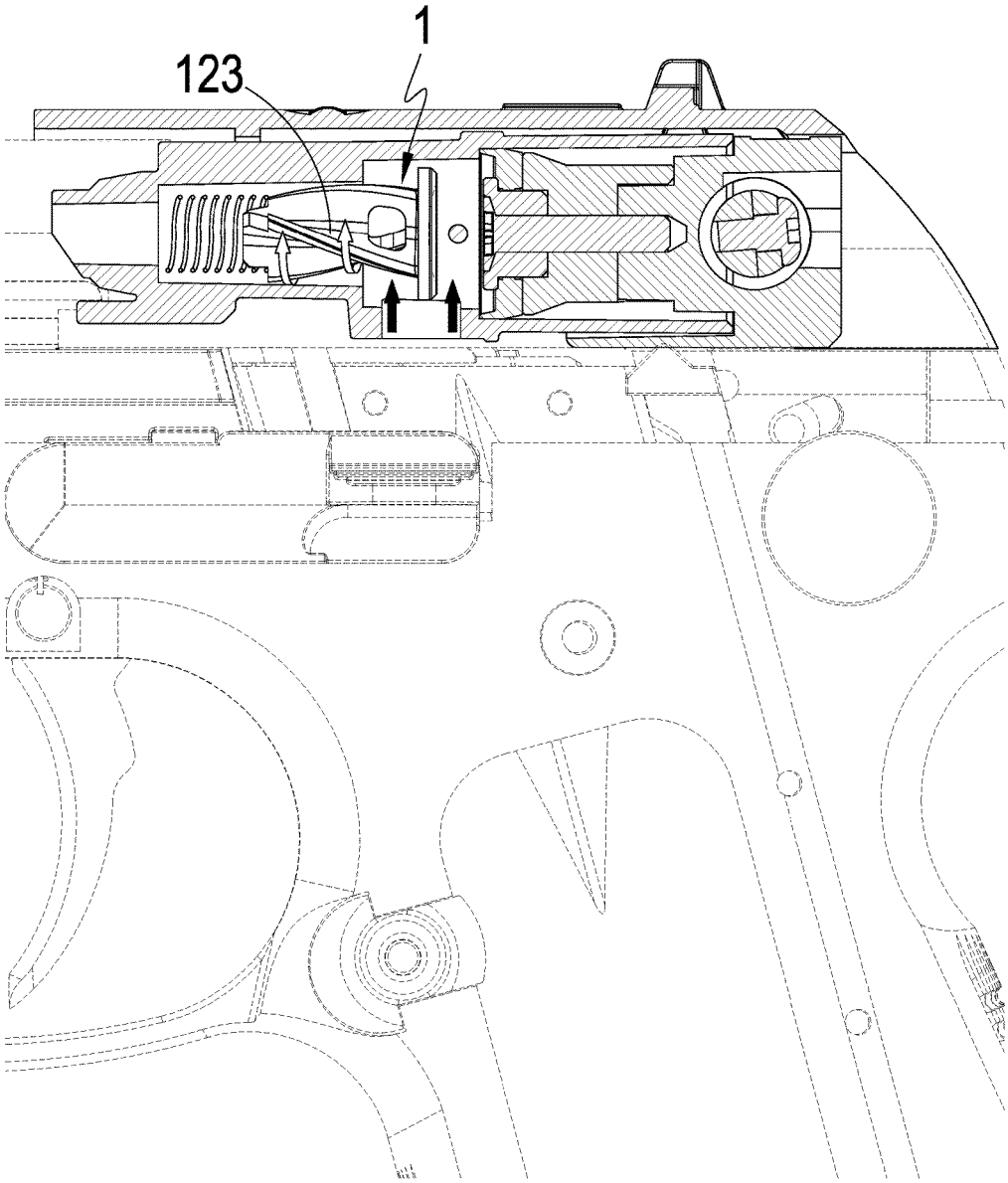
FIG. 5 is a schematic view of the present invention, illustrating the action of the gas flow flowing through twisted faces.
Figure 6:
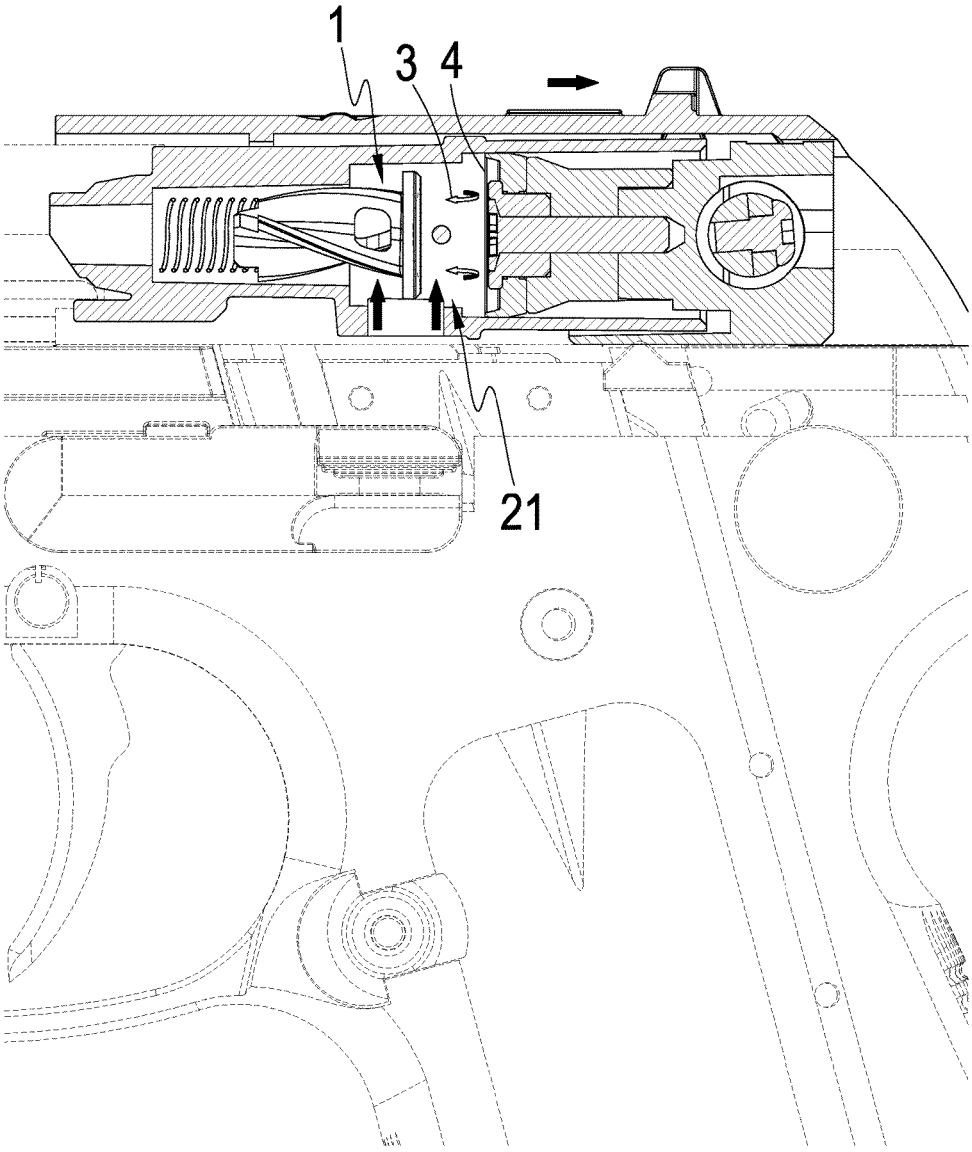
FIG. 6 is a schematic view of the present invention, illustrating the action of the air flow striking a concave groove portion.
Figure 7:
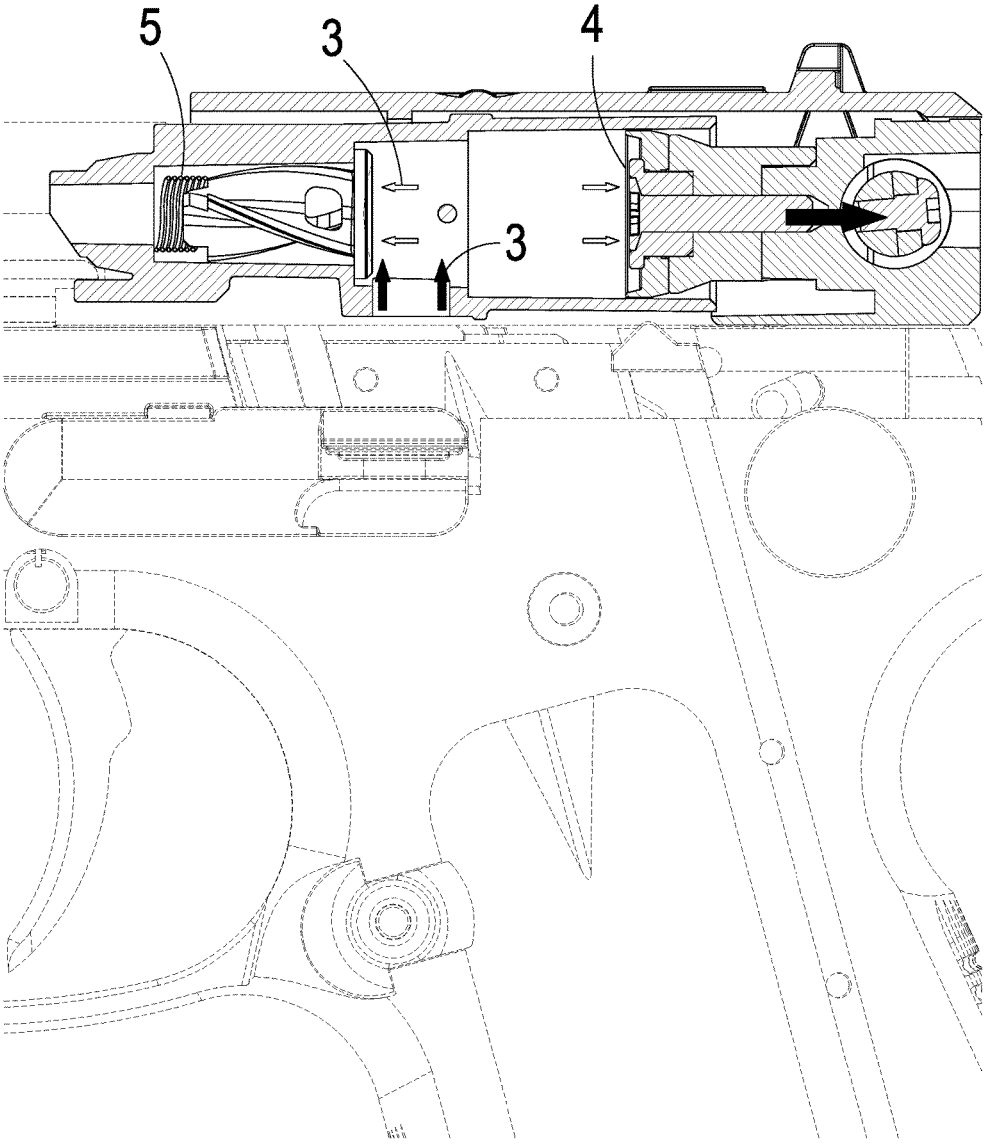
FIG. 7 is a schematic view of the present invention, illustrating the action of the flow dividing valve being rotated and moved.

Referring to FIGS. 1 and 2, a flow dividing valve 1 of the present invention mainly includes: a propulsion portion 11, a concave groove portion 111 for the gathering of gas being configured on one face thereof far away from a rotating auxiliary portion 12 mentioned below; the rotating auxiliary portion 12, extended from another face of the propulsion portion 11, a flow dividing hole 121 allowing gas to be passed through being configured thereon, a plurality of wing portions 122 being further configured on the rotating auxiliary portion 12, where an included angle between each two adjacent wing portions 122 is ranged from 115 to 125 degrees, and each wing portion 12 being twisted in a 90 degrees rotation toward a direction away from the propulsion portion 11, allowing the wing portions 122 to respectively have at least one twisted face 123; and a latching portion 13, configured on one end of the rotating auxiliary portion 12 far away from the propulsion portion 11, and allowing an elastic element to be engaged therewith.

Referring to FIGS. 1 to 7, the flow dividing valve 1 of the present invention is installed in a gas chamber 21 of a bolt 2, and the flow dividing 121 is adjacent to an airway 22. When high pressure gas 3 is passed through the airway 22 to the flow dividing valve 1, a part of the gas will flow toward the flow dividing hole 121, and another part thereof to one side face of the concave groove portion 111. Specifically, the gas 3 will first e contact with the twisted faces 123 when passed through the flow dividing hole 121 toward the front end of the gas chamber 21, and then press the twisted faces 123 after in contact with the twisted face 123 to cause the wing portions 122 to drive the entire flow dividing valve to rotate since the twisted faces 123 are set to be inclined. In addition, the part of gas 3 flowing forward behind the concave groove portion 111 is bounced back to the concave groove portion 111 after striking a piston 4 so as to allow the gas to be more gathered in the concave groove portion 111 that is formed to gather up gas, which generates a better push force to push the flow dividing valve 1 forward to squeeze the elastic elements. Finally, the entire bolt 2 is reset completely after the gas chamber 21 is allowed to be airtight. It can be seen from the description mentioned above that the above actions can not only push the piston 4 to move only using a small amount of gas, and most importantly, but remove conveniently the frost in the gas chamber 21 generated from the heat absorption of fuel gas upon the high-speed rotation of the flow dividing valve 1, allowing the flow dividing valve 1 to be very smoothly moved without any hindrance during the operation.

However, the above description is merely a preferred embodiment of the present invention, and therefore the scope of the present invention is not so limited, so that the simple modifications and equivalent structural changes applied in the use of the present description and drawings are to be construed in a similar manner and included within the scope of the present invention and expressly incorporated herein by reference.

Accordingly, the present invention has the following advantages compared to the prior art:

1. the flow dividing valve 1 is allowed to be rotated upon action through the wing portions 122 configured on the rotating auxiliary portion 12, thereby removing the frost generated inside the gas chamber 21 effectively.
2. the gas 3 can be gathered up through the design of the concave groove portion 111, allowing the gas chamber 21 to be sealed more smoothly, and further moving the piston 4 more smoothly, allowing the piston 4 to be reset completely.

I claim:

1. A flow dividing valve structure for a toy gun, comprising:

a propulsion portion;

a rotating auxiliary portion extended from one face of said propulsion portion, a flow dividing hole allowing gas to be passed through being configured on the rotating auxiliary portion, rotating auxiliary portion being configured with a plurality of wing portions each wing portion of the plurality of wing portions being twisted in a direction away from said propulsion portion, allowing said plurality of wing portions to respectively have at least one twisted face; and a latching portion, configured on one end of said rotating auxiliary portion distal to said propulsion portion allowing an elastic element to be engaged with the latching portion;

wherein a concave groove portion adapted to gather up gas is configured on one face of said propulsion portion distal to said rotating auxiliary portion.

2. The structure according to claim 1, wherein said flow dividing valve structure is installed inside a gas chamber of a bolt.

3. The structure according to claim 1, wherein an included angle is between from 115 to 125 degrees between each two adjacent wing portions of the plurality of wing portions.

4. The structure according to claim 1, wherein each said wing portion is twisted 90 degrees rotation in a direction away from said propulsion portion.

* * * * *